US006298618B1

(12) United States Patent
Lawson

(10) Patent No.: US 6,298,618 B1
(45) Date of Patent: Oct. 9, 2001

(54) CONSTRUCTIONAL SUPPORT

(76) Inventor: Robert Lawson, Lot 10, Alfred Street, Baringhup (AU)

( * ) Notice: Subject to any disclaimer, the term of this patent is extended or adjusted under 35 U.S.C. 154(b) by 0 days.

(21) Appl. No.: 09/331,000

(22) Filed: Jun. 14, 1999

(30) Foreign Application Priority Data

Jul. 2, 1998 (AU) ..... PP4451
Dec. 14, 1998 (AU) ..... PP7681

(51) Int. Cl.[7] ..... E02D 27/00; E02D 5/80

(52) U.S. Cl. ..... 52/292; 52/165; 248/530; 248/156

(58) Field of Search ..... 52/292, 749.1, 52/DIG. 1, 165, 155; 248/530, 163.1, 156, 354.1

(56) References Cited

U.S. PATENT DOCUMENTS

| | | | | |
|---|---|---|---|---|
| 213,932 | * | 4/1879 | Powell | 52/155 |
| 919,807 | * | 4/1909 | Bailey | 52/149 |
| 3,591,113 | * | 7/1971 | Foster | 248/519 |
| 4,027,802 | * | 6/1977 | Reynolds | 414/11 |
| 4,342,179 | * | 8/1982 | Hill | 52/155 |
| 4,404,780 | * | 9/1983 | Josephson | 52/126.7 |
| 4,706,921 | * | 11/1987 | Paulin | 248/545 |
| 5,104,074 | * | 4/1992 | Malloy | 248/156 |
| 5,317,844 | * | 6/1994 | Legler | 52/155 |
| 5,395,184 | * | 3/1995 | Gagliano | 405/229 |
| 5,791,635 | * | 8/1998 | Hull et al. | 256/64 |
| 5,797,226 | * | 8/1998 | MacKarvich | 52/155 |

FOREIGN PATENT DOCUMENTS 272260 1/1997 (NZ) .

OTHER PUBLICATIONS

Derwent Abstract No. J0505 K/24, SU 949066, Aug. 7, 1982.

Derwent Abstract No. H7119 K/28, SU 947284, Jul. 30, 1982.

Derwent Abstract No. S3915 D/36, SU 787552, Dec. 25, 1980.

* cited by examiner

*Primary Examiner*—Gregory J. Strimbu
(74) *Attorney, Agent, or Firm*—Dennison, Scheiner, Schultz & Wakeman

(57) ABSTRACT

A constructional support including three tubes secured to a central support member with the tubes defining guides for drilling holes into the ground and for guiding anchor members as they are being driven into the holes to secure the support with respect to the ground. In one embodiment, the longitudinal axes of the tubes intersect at a point along the longitudinal axis of the central support member. In another embodiment, the longitudinal axes of the tubes each lie in a respective plane which is parallel to the longitudinal axis of the central support member.

5 Claims, 3 Drawing Sheets

CONSTRUCTIONAL SUPPORT

This invention relates to improvements in constructional supports of the type capable of supporting building structures.

BACKGROUND OF THE INVENTION

Concrete and wooden stumps and piers are commonly used to support building structures constructed from timber beams, fabricated steel beams, aluminium beams and other structural materials. The concrete and wooden stumps and piers support a frame structure adapted to support flooring materials of various types to which internal frames constructed of various materials are in turn attached to form the complete building structure. The installation of concrete or wooden stumps or piers is labour intensive, requiring numerous holes and/or footings to be formed in the ground followed by the installation of the stumps or piers set at the required levels. Where a building is to be constructed on unstable soils, the stumps must be buried to a level where stable soil is present to provide the necessary support for the stump.

As a result of extensive testing and investigation, an alternative constructional support which performs satisfactorily in most soil types, including unstable soils or reactive clays, has been developed. The support can be installed by relatively unskilled operators, and does not require excavation or the formation of concrete footings.

The patent literature discloses several pile arrangements with angular anchor legs, such as SU949066 and SU947284, but these arrangements are not suitable for use in most domestic constructions. Similarly, New Zealand Patent 272260 discloses a driven foundation post arrangement with angled diagonally placed anchor posts. This arrangement does not lend itself to adaption from a driven foundation post arrangement to a relatively simple building stump replacement.

SUMMARY OF INVENTION AND OBJECT

It is the object of the present invention to provide a constructional support adapted to replace concrete or wooden stumps or piers in building constructions which provides at least equivalent support for a building structure and is installed with less difficulty than the known methods of installing concrete and wooden stumps or piers.

The invention provides a constructional support including a central support means for a load bearing member having a central longitudinal axis, three guide means secured to said support means and arranged in an equilateral triangular configuration, said guide means having passages with longitudinal axes extending angularly with respect to said central axis at an acute angle less than about 30°, said guide means being constructed to receive, as a snug fit, elongate substantially tubular anchor means for engaging the ground, and means for securing said anchor means in said guide means after said anchor means have been driven into the ground.

In the present specification, the term "tubular" is not restricted to circular configurations but includes oval, square, hexagonal, octagonal and other generally symmetrical configurations.

The invention also provides a method of installing a constructional support as defined above, including the steps of locating the constructional support in the required position on the ground, partially engaging the constructional support with the ground, inserting an elongate drilling means in each guide means in turn and drilling the ground along the axis of each guide means to a predetermined depth, inserting a tubular anchor means into each guide means, and securing each anchor means to each guide means or to the support.

Following the insertion of the anchor means, they are filled with a suitable grouting means. Alternatively or additionally, a further tubular means may be inserted into each anchor means to provide additional rigidity.

In one form of the invention, the central support means is adapted for engagement by said load bearing member adapted to support part of a building structure, such as a bearer support. If the bearer support is threaded, the central means may be threaded, or adjustment nuts may be fitted to the bearer support at positions above and below the central support means, to enable the bearer support to be rigidly secured with respect to the central support means. Alternatively, the bearer support may have a substantially tubular portion, in which case the central support member is configured to receive said substantially tubular portion.

The three guide means are preferably substantially tubular members and are secured together by means of an apertured plate or a threaded nut or the like defining said central support means, said tubular members being connected in the required angular orientation by bracing means, such as struts, which interconnect adjacent tubular members.

The guide means may comprise three lengths of plastics pipe held in an equilateral triangular pattern by means of a molded plastics collar or plate defining said central support means and engaging said pipes adjacent one end and holding them in an equilateral triangular pattern, said pipes also being engaged by a further molded plastic collar or plate, defining said bracing means closer to the other end of said pipes and which maintains said pipes in the required angular orientation while bracing them with respect to each other.

In a still further form of the invention, three metal tubular members defining the guide means are secured by welding to a central tubular riser defining the central support, the tubular members being skewed in a plane parallel to the central longitudinal axis of the riser so that the ends of the tubular members are accessible for drilling and for receiving the anchor means without being fouled by the central riser. Since the guide means are securely welded to the central riser, the bracing struts or bracing collar of the previous embodiments are not required.

The central riser is adapted to receive a bearer support, which is adjustable in height by telescoping the bearer support to the required level and bolting the support to the riser as required.

In the above embodiments, each of the guide means is preferably arranged at an acute angle to the central perpendicular axis or plane of the load support at an angle of about 5 to 20° to the central axis, and preferably at about 10° to 15° to the central axis.

The guide means are adapted to receive the anchor means as a snug fit within the passage. Where the pipes are plastic, they are fixed in position by a suitable plastics glue or by self-tapping screw means engaging the guide means and the anchor pipe engaged therein. If the guide pipes are metal and/or the anchor pipes are metal, screws are used to secure the anchor pipes in the guide pipes, or a blocking collar is secured in the open end of each guide means.

In use, the support is placed on the ground in the required position and at about the required level and the guide means are used to guide a drill for drilling holes adapted to receive the tubular anchor means to the required depth.

In order that the invention may be more readily understood, two presently preferred embodiments of the invention will now be described with reference to the accompanying drawings in which.

DESCRIPTION OF THE PREFERRED EMBODIMENTS

Figure 1:
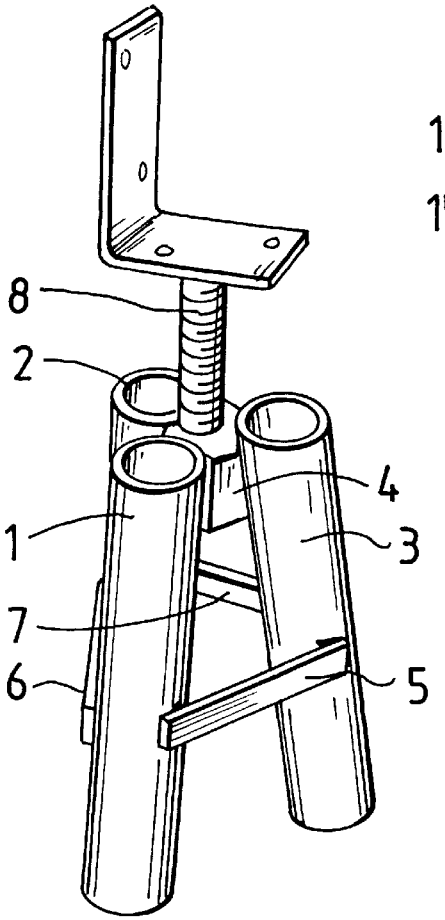
FIG. 1 is a perspective view of a first constructional support member showing an attached threaded bearer support.
Figure 2:
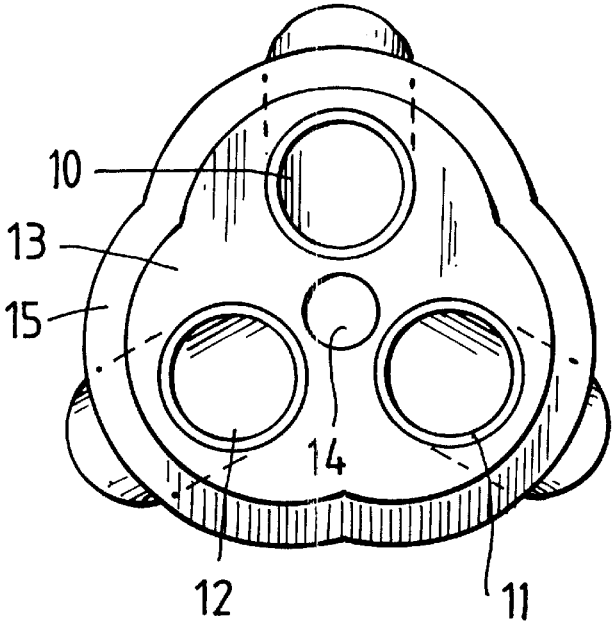
FIG. 2 is a top plan view of a second constructional support embodying the invention.

Referring to FIG. 1, the constructional support comprises three lengths of steel tubing 1,2 and 3 arranged in a equilateral triangular pattern, similar to that illustrated in FIG. 2, with each tube 1,2 and 3 extending outwardly from a central perpendicular axis at an acute angle of about 10°. The tubes 1, 2 and 3 are held together at the top by a central threaded nut 4, to which each of the tubes 1, 2 and 3 are welded. The tubes 1,2 and 3 are braced at a lower position by three straps 5, 6 and 7, each of which is welded to an adjacent tube 1, 2 and 3 to brace the tubes 1, 2 and 3 in the above defined angular orientation.

The central nut 4 is adapted to receive a threaded bearer support 8 of known configuration, as shown. Alternatively, the central nut 4 may be unthreaded or may comprise an apertured plate and the threaded support 8 is fixed adjustably by locking nuts above and below the central member.

In use the support is driven partly into the ground until the straps 5, 6 and 7 are about level with the ground. The tubes 1, 2 and 3 are then used to guide a drill which drills three holes to the required depth in the ground. Following drilling, three plastic or metal anchor pipes (not shown) are inserted as a snug fit into the tubes 1, 2 and 3 and are driven into the drilled holes in the ground to the required depth. The anchor pipes are secured to the tubes by self-tapping screws, or secured against escape from the guide tubes 1, 2 and 3 by collars of the type shown in broken outline in FIG. 4, and are then filled with a cement slurry or some other reinforcing material, if desired. The length of each anchor pipe is selected according to the soil type, but is typically about 300 to 450 mm for stable soils and about 450 to 550 mm for unstable soils. For particularly unstable soils, such as reactive clays, it may be necessary for the anchor tubes to be of a length sufficient to engage stable soil.

Figure 3:
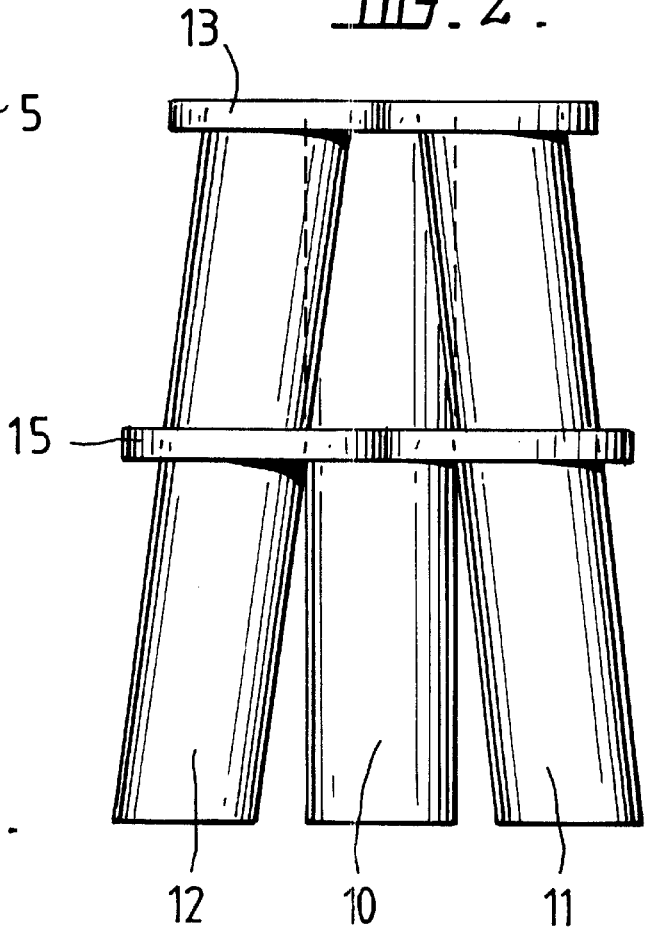
FIG. 3 is a side elevation of the constructional support of FIG. 2.

Referring now to FIGS. 2 and 3, in this embodiment, three plastic pipes 10, 11 and 12 which may be made from recycled plastics such as recycled PET, are held in an equilateral triangular configuration, illustrated in FIG. 2, by a molded plastic plate 13 having accurately formed openings receiving the pipes 10, 11 and 12 as a friction fit. The plate 13 comprises a flat plate of molded plastics having a central hole 14 drilled and tapped with a suitable thread capable of receiving a threaded bearer support of the type shown in FIG. 1. Alternatively, as described above, the hole 14 is untapped and locking nuts are positioned above and below the plate 13.

The pipes 10, 11 and 12 are held in an angular orientation of about 10° to a central perpendicular axis by a second molded collar or plate 15, illustrated in FIG. 3, having accurately positioned openings which receive the pipes 10, 11 and 12 in the configuration shown and maintain them in this position under the loadings expected to be experienced in use.

This embodiment of the invention is used in a manner equivalent to that described above, and in each case, the plastic anchor pipes (not shown), which are received in the guide pipes 10 to 12 as a snug fit, are held in their final driven positions by plastics cement or by screws engaging the guide pipes and the anchor pipes or by collars similar to those described below.

Figure 4:
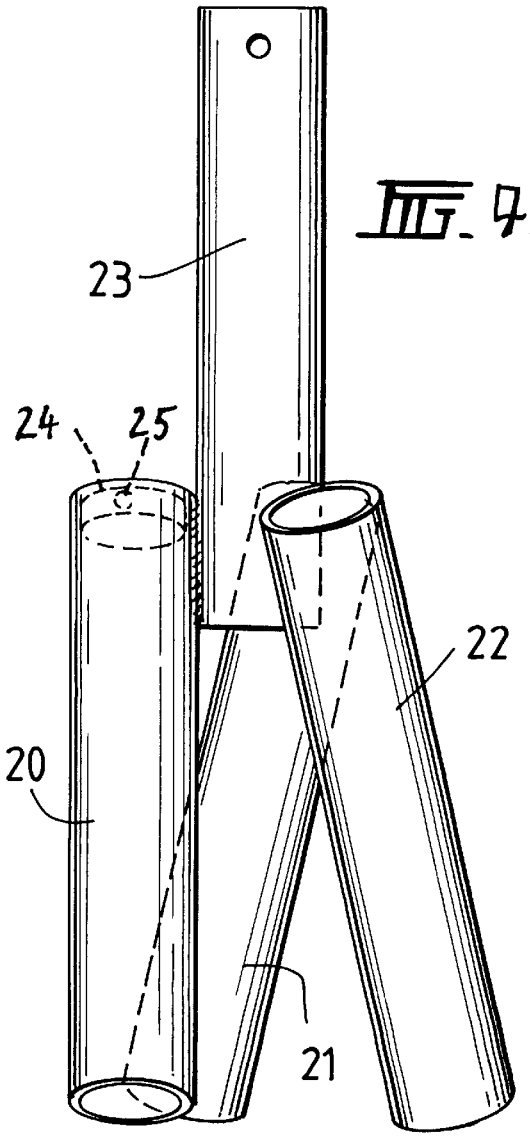
FIG. 4 is an elevation of the third embodiment of the constructional support.
Figure 6:
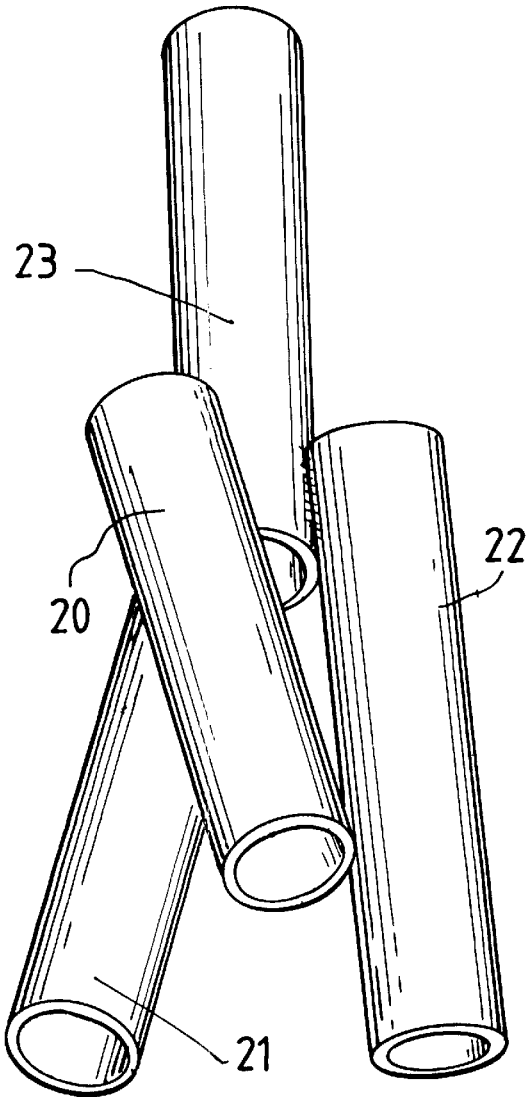
FIG. 6 is a perspective view from the lower one end of the support of FIG. 4. Dimensions illustrated in these drawings are typical rather than restrictive.
Figure 5A:
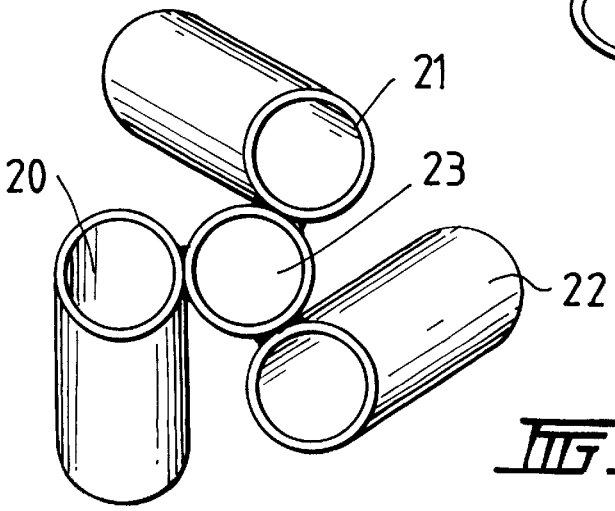
FIG. 5A is a plan view of the support of FIG. 4.
Figure 5:
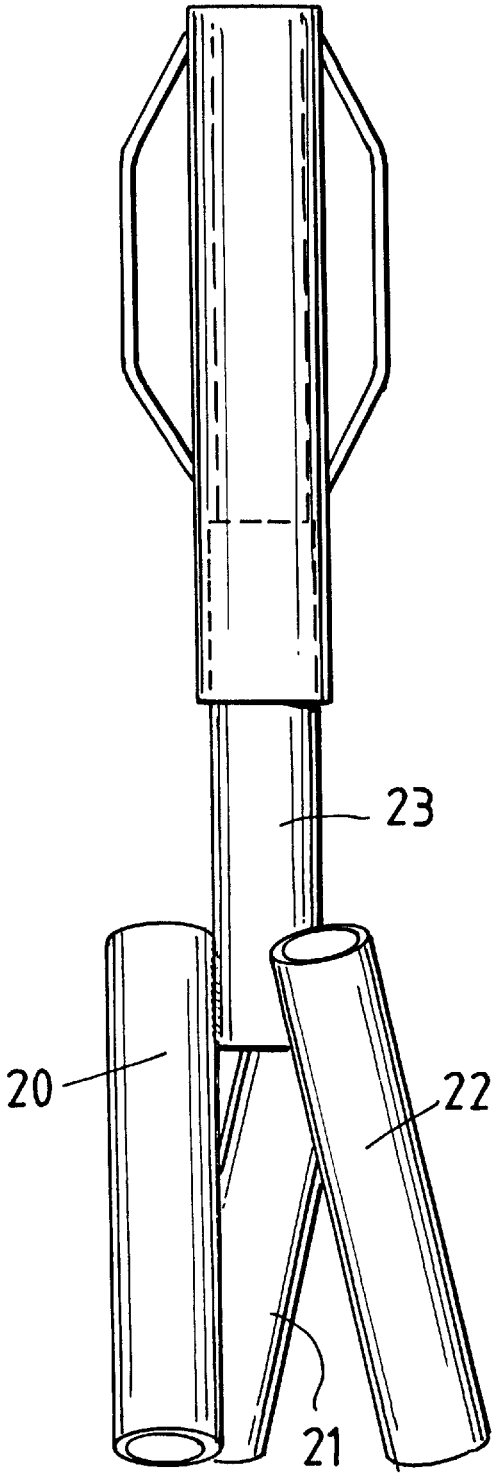
FIG. 5 is a schematic illustration showing the support being installed by means of a hand post driver.

Referring now to FIGS. 4 to 6, the constructional support embodying the invention comprises three lengths of steel tubing 20, 21 and 22, welded in an equilateral triangular configuration to a central riser in the form of a further length of steel tubing 23. Each of the guide tubes 20, 21 and 22 extends angularly to the central riser tube 23 in a plane parallel to the central vertical axis of the riser 23. In this way, the guide tubes 20, 21 and 22 are skewed with respect to the central riser so that their upper ends are free to receive a drill followed by metal or plastic anchor pipes as in the previous embodiments.

By providing a rigid central riser to which the guide tubes 20, 21 and 22 are securely welded, the bracing plates of the embodiment of FIG. 1 are not required and the relatively expensive central nut 4 is replaced by a less expensive tubular riser by means of which the constructional support can be driven into the ground for installation by means of a hand held post driver, as illustrated schematically in FIG. 5 of the drawings.

Figure 4A:
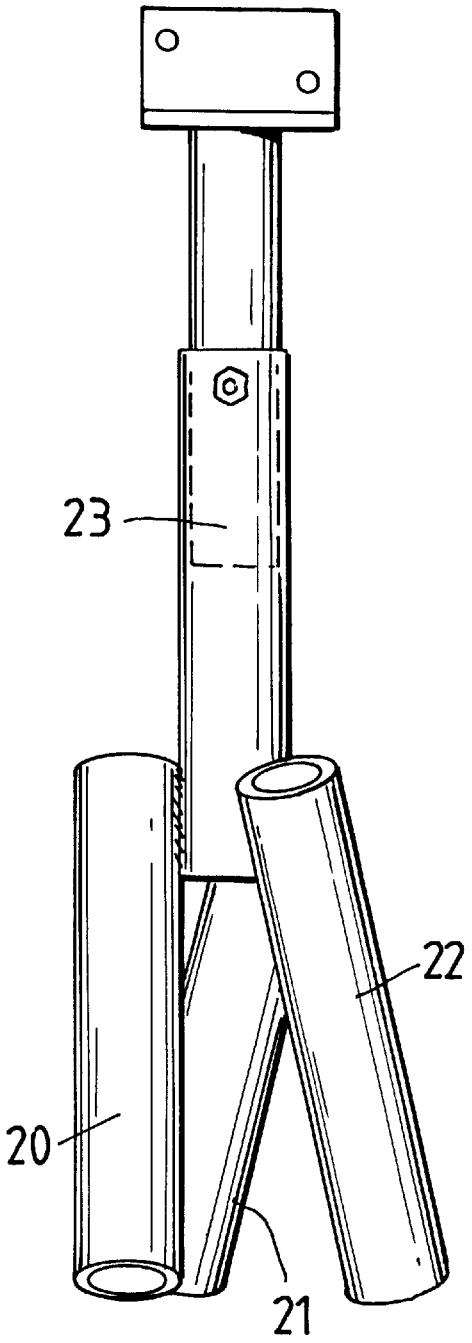
FIG. 4A is a schematic elevation showing a bearer support attached to the constructional support of FIG. 4.

The central riser 23 is adapted to receive a bearer support which can be drilled and bolted at any desired adjusted height, as shown in FIG. 4A.

In the embodiment of FIGS. 4 to 6, it has been found that the guide tubes 20, 21 and 22 are most conveniently arranged at an angle of about 15° to the central vertical axis of the riser 23. This angle may be changed without reducing the effectiveness of the support, the only requirement being that the ends of the guide tubes 20, 21 and 22 are free to receive a drill and anchor tube without being fouled by the central riser tube 23.

The support of FIGS. 4 to 6 can be inexpensively fabricated using a jig and a welding machine. The fabrication process lends itself to automation whereby production costs can be further reduced.

It will be appreciated that the above embodiments of the invention stress the importance of arranging the guide pipes in an equilateral triangular pattern since this pattern provides equal support in every direction of the supporting device while minimising fabrication costs. The embodiments also stress the need for the anchor means to be tubular and to be a snug fit within the guide pipes. This does not require both the guide pipes and the anchor pipes to be of the same configuration, although this is probably most convenient, but rather that the anchor pipes should engage the guide pipes sufficiently to prevent the anchor pipes moving externally to any material extent within the guide pipes.

The support of the present invention provides a viable, relatively low cost, alternative to wooden or concrete stumps and is in effect a three legged stump or a three legged mini-piling system in which the anchor pipes which engage the holes drilled in the ground constitute small piles which provide the necessary constructional support for bearers engaging the bearer support engaged with the central nut or opening in the top collar of the support, or the central riser. It will be appreciated that the collar described above may have any desired shape, including a rectangular shape which is adapted to engage a bearer channel. Similarly, in the embodiment of FIG. 1, the central nut 4 can be replaced by a metal support plate, similar to collar 13 to which the guide pipes are secured such as by welding.

The embodiment of FIG. 4 provides a relatively inexpensive alternative to the embodiment of FIG. 1 which lends itself to efficient fabrication techniques. In each of the above embodiments the anchor pipes can be held in the guide tubes by means of self tapping threaded screws or by means of narrow collars, such as 24 illustrated in FIG. 4, engaging the upper ends of the pipes 20 to 22 and held in place by anchor screws 25. Where plastic anchor pipes are used, the anchoring performance can be improved by the insertion of a galvanized metal pipe within the anchor pipe and extending for at least part of the length of the plastic pipe, the galvanized metal pipe being filled with suitable grouting material to seal the pipe, the outer plastic pipe acting to protect the galvanized pipe against corrosion from the surrounding soil.

What is claimed is:

1. A ground-engaging construction support for supporting a load bearing member comprising:

a support member having a top, a bottom, an outer sidewall connecting said top and bottom, and a longitudinal axis;

three guides, each having an outer sidewall, connected to said support member, each of said guides having a longitudinal axis and a first ground engaging end spaced apart from said support member bottom, said guides being arranged in an equilateral triangular configuration around said support member with the outer sidewall of each of said guides contacting the outer sidewall of said support, such that the longitudinal axis of each of said guides lies in a plane parallel to the longitudinal axis of said support member so that a second end of each of said guides is accessible for drilling, said guides each comprising a passage and said longitudinal axis of each of said guides extending angularly at an acute angle less than about 30 degrees with respect to said longitudinal axis of said support member, each passage of each said guide being constructed to receive an elongate anchor means for penetrating the ground, and means disposed within each said passage for enclosing and securing a distal end of each said anchor means within each said passage after said anchor means has been driven into the ground.

2. The support of claim 1 wherein said support member and said guides are integrally formed.

3. The support of claim 1 wherein said support member comprises a tube having a tube axis corresponding to said longitudinal axis of said support member.

4. The support of claim 1 wherein said acute angle less than about 30 degrees comprises an angle of between about 5 degrees and about 20 degrees.

5. The support of claim 1 wherein said acute angle less than about 30 degrees comprises an angle of between about 10 degrees and about 15 degrees.

* * * * *